US007857318B1

(12) United States Patent
Shoemaker, Jr. et al.

(10) Patent No.: US 7,857,318 B1
(45) Date of Patent: Dec. 28, 2010

(54) CRANE GAME WITH RANDOM MOTION CRANE ACTUATION

(75) Inventors: Stephen Shoemaker, Jr., Redondo Beach, CA (US); Edward Che, Redondo Beach, CA (US)

(73) Assignee: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 12/542,884

(22) Filed: Aug. 18, 2009

(51) Int. Cl.
*A63F 9/00* (2006.01)
*A63F 7/36* (2006.01)

(52) U.S. Cl. ..... 273/448; 273/447

(58) Field of Classification Search ..... 273/447, 273/448

See application file for complete search history.

(56) References Cited

U.S. PATENT DOCUMENTS

| | | | | |
|---|---|---|---|---|
| 5,855,374 | A | 1/1999 | Shoemaker, Jr. | |
| 2002/0067002 | A1 * | 6/2002 | Yoshida et al. | 273/447 |
| 2002/0140171 | A1 * | 10/2002 | Ochi | 273/448 |
| 2007/0018407 | A1 * | 1/2007 | Shoemaker | 273/356 |

* cited by examiner

*Primary Examiner*—Raleigh W. Chiu
(74) *Attorney, Agent, or Firm*—Fulwider Patton LLP

(57) ABSTRACT

An arcade type crane game includes a crane that moves in a two dimensional random motion over the playing field of the prizes without control from the player. After a period of the random motion, a pick up device stops its random motion and lowers in the location where it stops and attempts to pick up a prize below. In the case of a vacuum pick up device, the vacuum is lowered and acquires (or attempts to acquire) the nearest object below the vacuum. In the case of a claw type crane, the claws actuate after being lowered to the level of the prizes to acquire (or attempt to acquire) a prize below. By removing the controls from the player, various elements of skill have been removed from the game and replaced by chance.

9 Claims, 4 Drawing Sheets

CRANE GAME WITH RANDOM MOTION CRANE ACTUATION

BACKGROUND

Arcade type crane games are a mainstay of video arcades, pizza parlors, restaurant lobbies and various other locations where games are played. The crane game includes a housing with a play area that incorporates prizes that can be viewed by a player through transparent walls, and a pick-up device that hovers over the prizes and lowers in an attempt to pick-up and capture a prize for the player. Traditional prizes include plush animals, toys, candy, plastic bubbles filled with items, and the like. Two of the most prevalent pick up devices are claw-type devices and vacuum devices. Crane games of this type can be seen in U.S. Pat. Nos. 5,513,772 and 4,718,667, the contents of which are fully incorporated herein by reference.

The traditional crane games of the past have largely relied to a large extent on the skill of the player. Maneuvering the pick-up device to the desired location in an attempt to pick up a particular prize and exercising the skill to capture the prize was part of the lure of the game. However, there are situations where it is more desirable to rely on pure luck rather than a combination of skill and luck. The present invention is directed to a crane game where skill has been reduced or completely eliminated and the game is purely or predominantly a game of chance.

SUMMARY OF THE INVENTION

The present invention is an arcade type crane game wherein a player initiates a game attempt by activating the game, as through the payment of a token, game card, bill, or other activation means. The game then begins by moving a crane in a two dimensional random motion over the playing field of the prizes without control from the player. The random two dimensional motion of the crane can activate by virtue of the player paying, or the random motion can be part of the attraction to lure players to the game. After a period of the random motion, the pick up device stops its random motion and lowers in the location where it is stopped and attempts to pick up a prize below. In the case of a vacuum pick up device, the vacuum is lowered and acquires (or attempts to acquire) the nearest object below the vacuum. In the case of a claw type crane, the claws actuate after being lowered to the level of the prizes to acquire (or attempt to acquire) a prize below. By removing the controls from the player, all elements of skill have been removed and the game operates purely on chance.

Alternatively, some level of skill can be introduced into the game by allowing the player to select when the random motion stops. That is, the crane moves in a random motion until the player selects a "STOP" button, whereupon the crane immediately lowers in an attempt to capture a prize. Here the player does not control the two dimensional movement of the crane, which is programmed to be random, but can wait until the crane happens to pass over a desired target. If the player hits the stop button with the correct timing and accuracy, the desired target may be captured.

DETAILED DESCRIPTION OF THE PREFERRED EMBODIMENTS

The present invention is a new variation of crane games invented by the present inventor, including those described in U.S. Pat. Nos. 5,855,374, 6,598,881, and 6,770,001, the contents of each of which are fully incorporated herein by reference.

Figure 1:
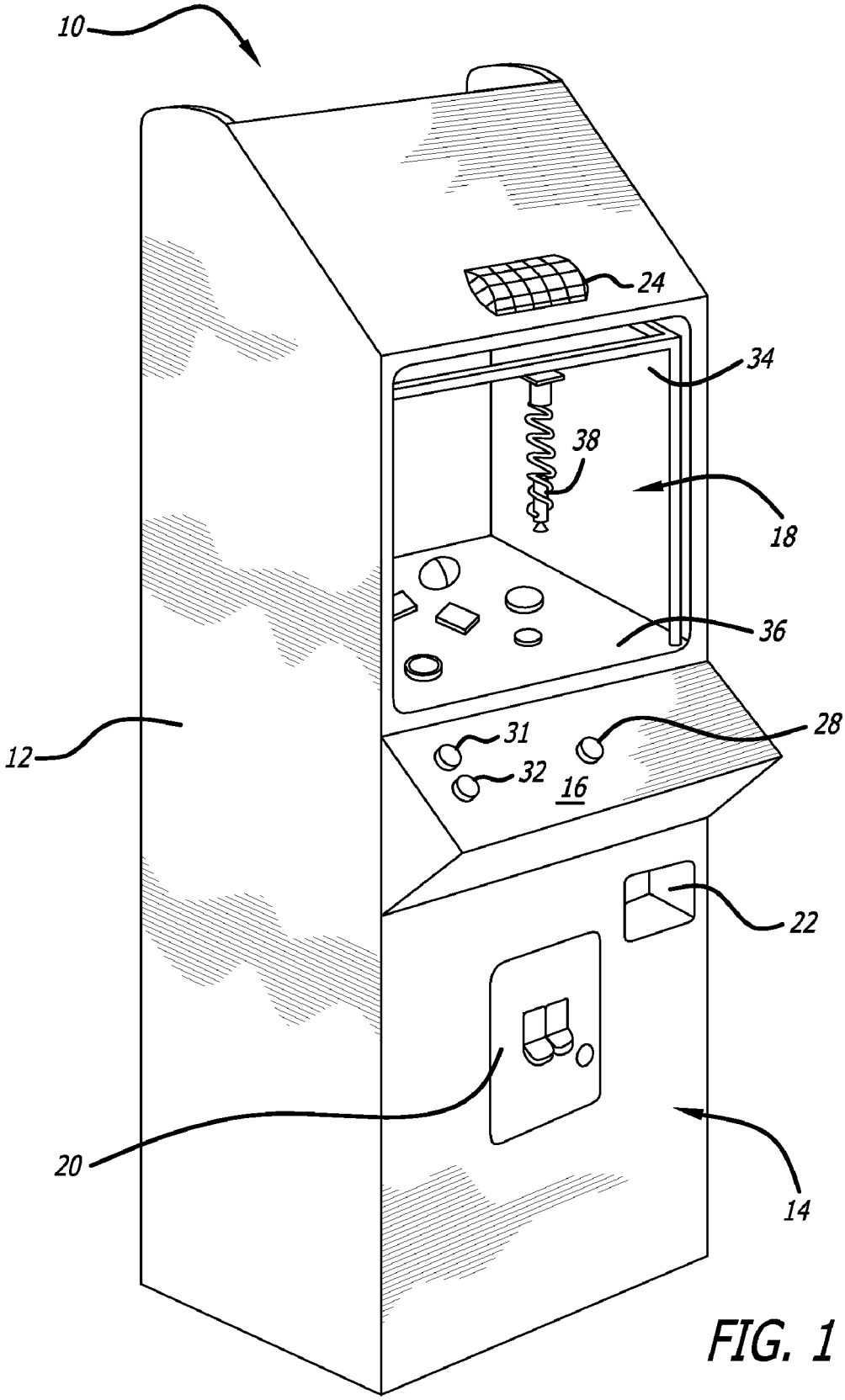
FIG. 1 is a perspective view of a crane game apparatus of the invention.

FIG. 1 is a perspective view of one embodiment of a game apparatus 10 in accordance with the present invention. Game apparatus 10 includes a housing 12, front panel 14, and a playing area 18. Housing 12 provides a support for the other components of the game apparatus. Housings can take a wide variety of forms; for example, as shown in FIG. 1, housing 12 may be of the stand-up arcade game variety in which a player stands in front of the game or sits on a stool when playing the game. In other embodiments, other types of housings may be provided. For example, a counter-top housing, including approximately the upper half of housing 12 shown in FIG. 1, can be used when the game apparatus is desired to be placed on a table, counter top or other similar surface.

Front panel 14 can be positioned below and/or above the player controls 30 and playing field 18, as shown in FIG. 1. The front panel can also be positioned in a wide variety of other locations on housing 12. Front panel 14 includes a coin deposit slot 20, dispenser 22, and speaker 24. Coin deposit slot 20 typically accepts standard currency coins, game tokens, or bills that are often available in an arcade environment. In some embodiments, other types of monetary input may also be provided using a magnetic card reader to read a card with a magnetic strip that holds game credit information, or a bank card such as a credit card, debit card, etc. A coin deposited in coin deposit slot 20 (or other payment method) starts a game. Dispenser 22 is used to provide prizes to players that have successfully played the game. Dispenser 22 guides a prize from playing area 18 to a player-accessible door and/or aperture from which the player retrieves the prize. Alternatively, the dispenser 22 may provide tickets, coupons, receipts, or other payment in games where the "prizes" are not removed from the playing area. For example, in certain games where gambling may be employed and the game is used to pick up poker chips of various denominations, the poker chips are not distributed to the player but rather a reader reads the poker chip and prints a receipt of the chip's denomination that can be redeemed elsewhere. In this manner, the playing field does not have to be replenished periodically due to the prizes being removed from the game.

Speaker(s) 24 can emit sounds based on game actions and other game states and is controlled by a game control system as described subsequently. The front panel 14 can also include other features if appropriate. For example, in an alternative embodiment, a ticket dispenser (not shown) may be included on front panel 14 if desired to dispense a ticket award to the player based upon a game score, characteristics of a captured object, or other result or event of a game, rather than (or in addition to) providing the player with a prize in dispenser 22.

Player control panel 16 allows a player to manipulate events in the game, and includes an actuation device such as a push button 28 to initiate the random movement of the crane. Alternatively, the motion of the crane in the two dimensional horizontal plane can be ongoing, and help attract players to the game. Game action occurs in playing area 18, where a pick up mechanism is randomly moved above the playing area 18 using a random motion device. In one embodiment, the player actuates the crane using the push button 28 when the crane's random motion moves over a prize desired by the player. Once the push button 28 is pressed, the crane immediately stops moving in its random motion above the playing area and the game then lowers the crane in the spot where it was when the player pressed the button 28, and if the player is accurate the crane may capture a prize and carry it to the dispenser 22. Buttons 31,32 can also be provided to select various game functions, such as sensitivity of the controls, number of players in a game, activate sound, etc. For example, in the described embodiment, a slow button 31 can be pressed by the player to slow down the movement of the crane during the random motion portion of the game so as to allow the player a better opportunity to acquire the selected prize. In some embodiments, a player may get multiple chances to guide the pick up mechanism with one coin or credit, or, alternatively, the player may be required to insert additional coins.

Game playing area 18 is used to display the game action and prizes to a player and is the area where game action occurs. A transparent shield 34 can prevent the player from interfering with game action. The playing area 18 houses a prize display area 36 and a pick-up device, which can be a claw type pick-up device or a vacuum pick up device 38. The game's controller governs the motion of the pick up device above the playing field, in a random motion that covers the entire playing area 18. At some point the player actuates the crane via control panel 16 to stop the motion of the crane in the horizontal plane and lowers the head so that a prize may be picked up. If a prize is picked up, the game controller senses the acquisition and automatically guides the pick up head to a conveyor device (not shown), releases the prize onto the conveyor, and moves back into a starting position. The conveyor moves the prize to a pathway that leads to dispenser 22. Alternatively, a printer prints out a receipt that the player collects from dispenser 22 reflecting the value of the prize won.

Figure 2:
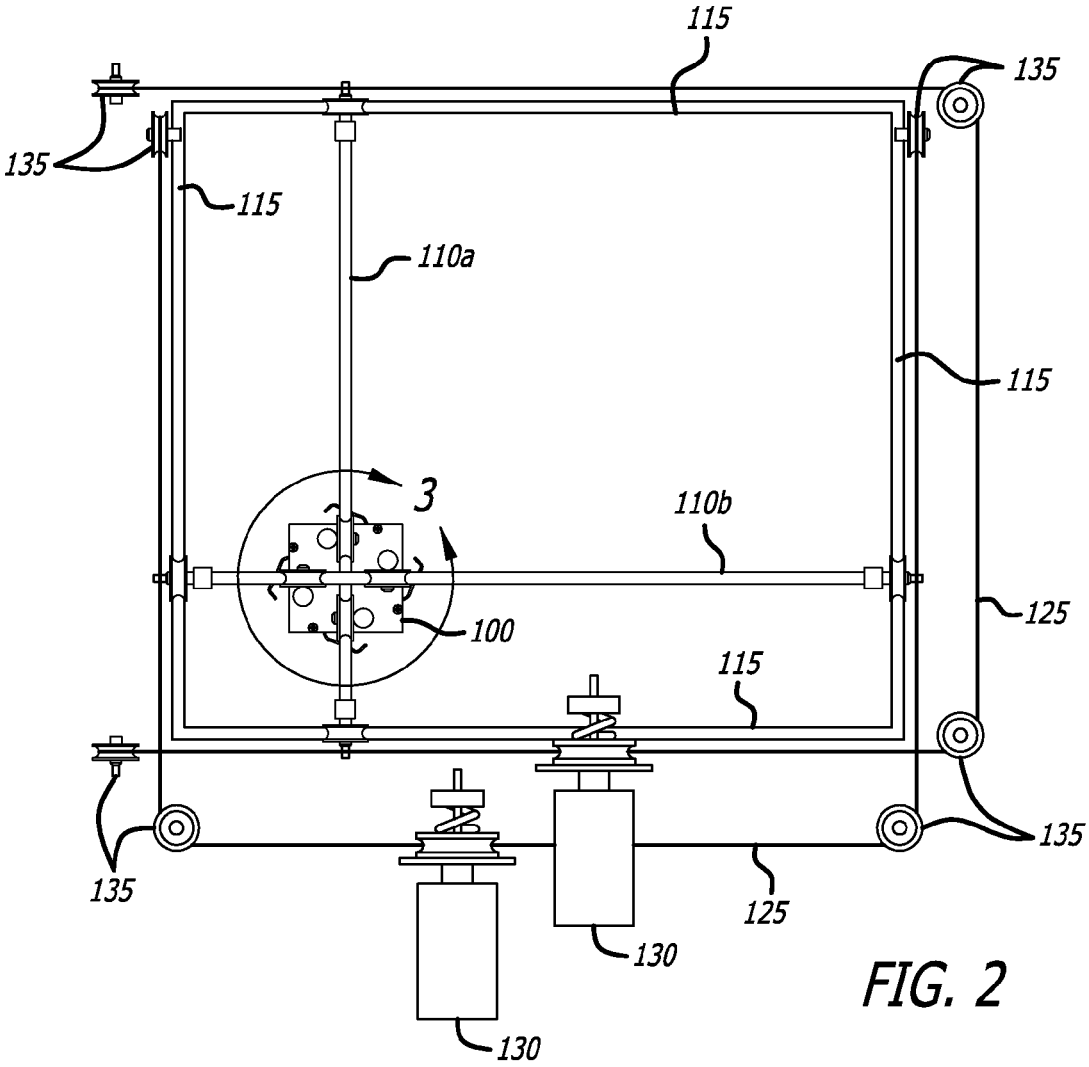
FIG. 2 is a top view of a drive system for the game apparatus for generating random motion of the pick-up device.
Figure 3:
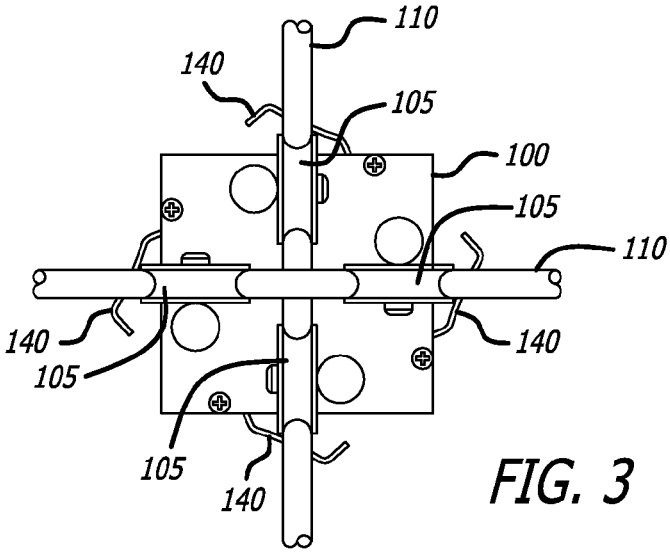
FIG. 3 in an enlarged, plan view of the pick-up device showing the connections and sensors.
Figure 4:
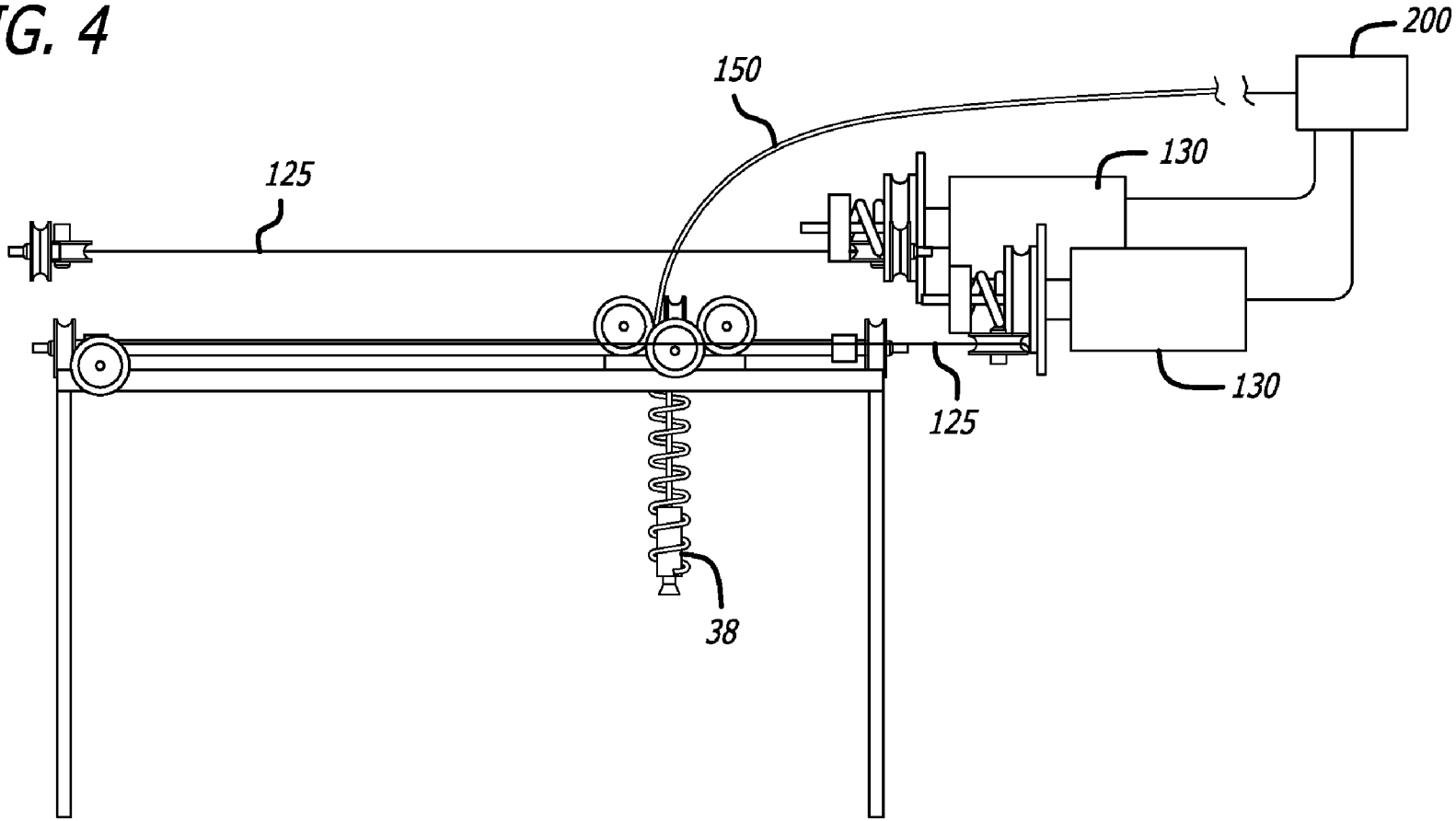
FIG. 4 is a side view of an embodiment of a pick-up device driven by the drive system of FIG. 2.

FIG. 2 illustrates a two dimensional support system for the pick-up device where the pick-up device is driven above the playing field 18 in a random motion. The pick-up device is mounted on a carrier 100 which can be a rectangular member that has four wheels 105 that ride on elongate rods 110. Each rod 110 is mounted to rails 115 that border the playing area 18 above the prizes. The rods 110 are connected via cables 125 to a pair of two-way motors 130 using a pulley system 135. Each motor 130 is connected to an associated cable 125, where one motor and cable drive rod 110*a* and one motor and cable drive rod 110*b*. For purposes of illustration only, in FIG. 2 rod 110*a* moves the pick-up device in the horizontal direction (left to right and right to left) on the page, and rod 110*b* moves the pick-up device in the vertical direction (up to down and down to up) in the drawing. Of course, in the actual game the movement is all in a substantially horizontal plane.

The two motors drive the rods, which in turn carry the carrier 100 across the playing field. The carrier 100 may be equipped with four sensors 140 each projecting from a side of the carrier 100. The sensors 140 can operate as switches such that contact with the sensors 140 by the rods 115 at the border of the grid sends a signal via cable 150 to a controller 200 to change the direction of the appropriate motor so that the carrier 100 reverses direction. With the motors operating independently, the motion in the x and y directions are unrelated leading to a semi-random motion. The controller can also be programmed to change the direction of the motors at various intervals that lead to even more random motion, where the path of the carrier 100 (and thus the pick-up device 38) appears to move all over the two dimensional grid without any control by the player as to which direction the carrier moves. This automated, random motion eliminates the player's involvement in guiding the pick-up device over the playing area, and thus most of the skill is eliminated in favor of chance. The game can further be modified to be a complete game of chance if the controller, rather than the player, stops the random motion and actuates the pick-up device after a random period of time. In this option, the player merely pays for a random chance at winning a prize and has no control over the operation of the game. Such a variation would be valuable to casinos or gaming establishments that do not want skill to factor in to the winning of the game.

Figure 5:
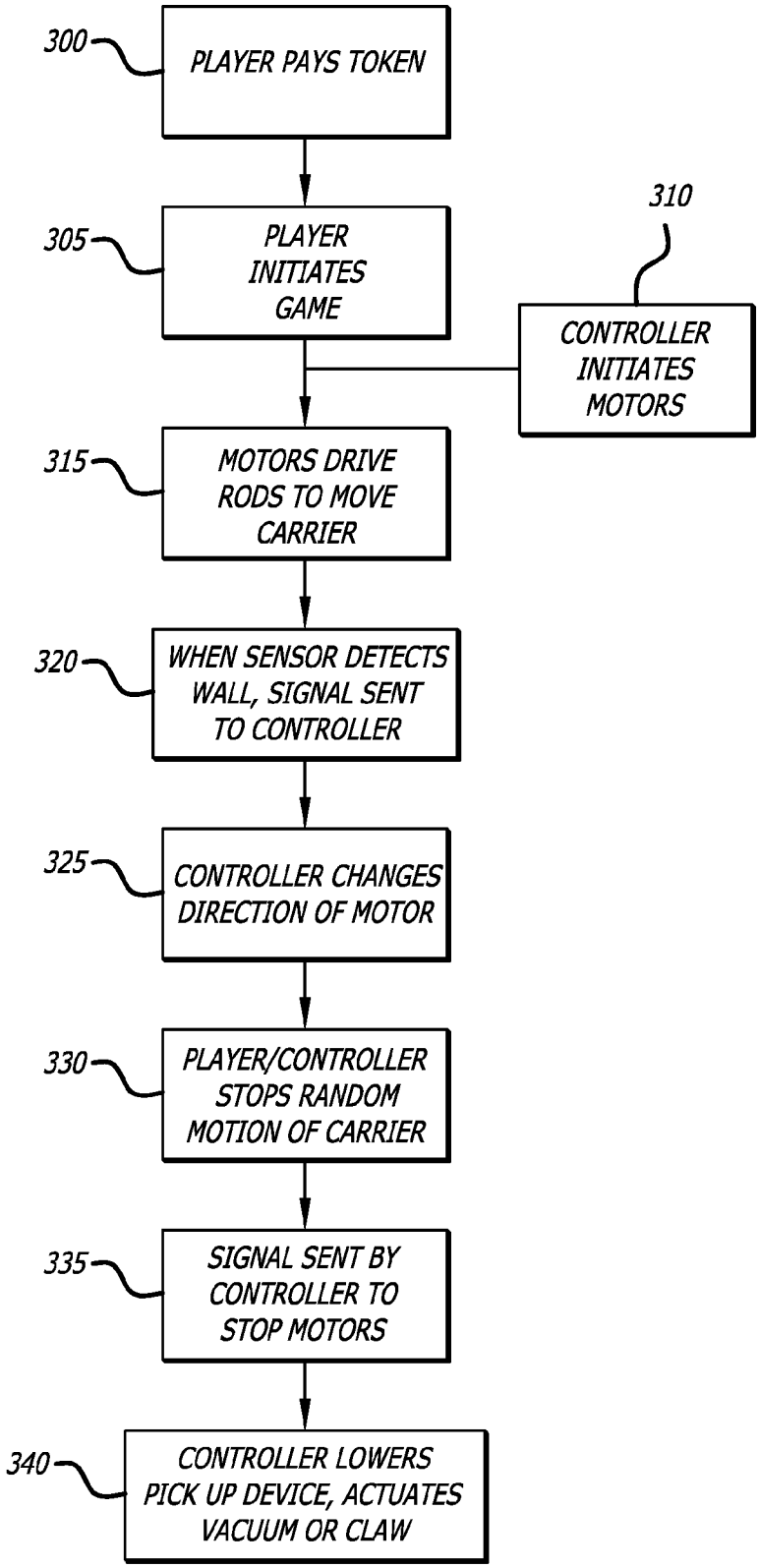
FIG. 5 is a flow chart of an operation of the amusement device of the present invention.

FIG. 5 illustrates generally how the game proceeds. In step 300 the player begins the game by placing a token in the slot 20 or otherwise pays for the game to play. The game, once the token or payment is received and acknowledged, may initiate the motors 130 automatically or it may require that the play depress button 28 to initiate game play in step 305. The controller of step 310 sends a signal to the motors 130 to begin driving the pulleys so as to move rods 110*a,b* along the rails 115 (step 315) which in turn moves the carrier 100. As the carrier moves over the playing field it will eventually approach either the rails 115 or some wall, whereupon the sensors 140 will be triggered by the contact with the opposing surface. The sensor sends a signal to the controller in step 320, which causes the controller to then change the direction of the motor which moved the carrier toward the opposing surface, thereby changing the direction of the carrier (step 325). The system continues to move the carrier, and thus the pick-up device, in a random motion over the playing field without guidance or control by the player. In step 330, either the player or the controller stops the random motion, such as by pressing button 28 if by the player or by sending a command to the motors to cease after a predetermined or random period of time has lapsed since the beginning of the game. If controlled by the controller, the amount of time elapsed before the end of the game should be different for each successive game to prevent a "pattern" of motion for each game. The controller sends a signal to the motors 130 (step 335) to stop and initiates the lowering of the pick-up device (step 340).

One version of the game could be used for gambling, where the controller 200 controls all movements of the pick-up device in a random manner. Where a vacuum pick-up device 38 is used, the targets can be poker chips or the like of various sizes. Using this mode the vacuum pick-up device would hover over the playing field and move in a horizontal plane in a random manner. The player would merely watch as the crane moves above the targets for a random period of time determined by software in the controller, whereupon the vacuum device would start lowering. The outcome of the device involves no skill by the player. In this game the number of wins per try could be percentaged and the overall reward could be regulated by the value of the poker chips in the game relative to the cost to play. A progressive play option could also be included, where chips could be identified as multipliers and if captured by the crane, the player's winnings would be multiplied by the multiplier and the chip would be returned to the playing field. For example, for a $5 play if a "1" multiplier chip was captured the player would be returned $5. If a "10" multiplier is captured the player would be returned the value of $50, and so forth.

The operation of the various components are fully set forth in the other patents incorporated herein (in particular U.S. Pat. No. 5,855,374), and their disclosures being incorporated herein by reference are unnecessary here. It is to be understood that one of ordinary skill in the art, having reviewed the disclosure herein, will readily recognize that various modifications can be made to the device described here to carry out the objects of the invention, and this application is intended to include all such modifications. Accordingly, the present invention should not be limited solely to those embodiments described or shown, but rather the scope of the invention is properly measured by the words of the appended claims.

The electronic system may be implemented on a PC board measuring 6.5"×5" and powered by a 450 W ATX computer power supply. A 5 volt minimum current load is provided by an off-board power resistor connected to one of the auxiliary power connectors. The 12 V load is provided by two 50 W halogen lamps, and a cooling fan, likewise connected to one of the auxiliary connectors which carries the 12 V output. The bill or token validator is powered directly by a stand-alone 24 VAC power supply.

In a preferred embodiment, sixteen DIP switches are read at power-up. These select operating parameters such as cost-per-play, play time, etc. Four switch inputs which can be connected either to the 4 direction limit switches mounted on the moving carriage, or alternatively, to a 4-switch joystick. Two "Z-axis" control switches including the down-limit switch and a vacuum operated switch. One input may be assigned to the coin-switch input, and one to the bill validator input.

Motor outputs are driven by two L298H motor controllers. A sound amplifier may be included with a volume control. The hardware system may also include a 40 pin PIC microcontroller which is programmed to function as one of two games, as selected by an on-board jumper. In both games a sound track accompanies the game play.

One of two game functions can be selected by an on-board jumper. The primary distinction is the "Random Chance" game, or the "No Random Chance" game. In the Random Chance games the carriage moves continuously over the playfield in a random fashion. There is no joystick provided and the player is given only limited control over the outcome of the game. The random nature of the carriage movement is the result of the 4 direction limit switches on the carriage, as well as the output of an on-board true-random-event-generator.

When the carriage moves to one of its X-Y limits, that motor will automatically reverse direction. The action of the other motor is determined by the instantaneous output of the Random Event Generator such that it will either: a) CONTINUE in the same direction as before, b) REVERSE the previous direction, or c) turn OFF resulting in a straight traverse of the playfield as driven by the other just-reversed motor. The Random Event Generator insures that each of these three results has an equal probability of being selected and hence the result of any contact closure of a limit switch results in a completely unpredictable movement of the carriage.

On each and every limit-switch contact all power is momentarily removed from the motors to minimize switching transients. Also, at each reversal a brief "UP" signal is sent to the Z-axis motor to insure the vacuum head remains fully UP and in contact with the carriage.

If the game has player-credit, as purchased using either the coin-mechanism or the bill validator, the player DOWN pushbutton switch is enabled. One of two modes of play are possible, operator selectable by a DIP switch. In the SRC (Slightly Random Chance) mode, at the moment the player presses the DOWN pushbutton the carriage movement ceases, and a brief UP signal is sent to the Z-axis motor to insure that the vacuum head is not swinging. The vacuum head then descends, with the pump running and a vacuum present at the suction cup. When the DOWN LIMIT switch is activated, indicating contact with a either a prize or the playfield floor, a brief pause is initiated. After the pause the vacuum head rises, with the vacuum pump operating, for a time period sufficient to insure that the vacuum head has reached the full UP position.

At the DOWN limit, the vacuum switch on the carriage detects whether or not a prize has been captured and held by the vacuum suction cup. If so, the carriage travels to the front-left corner of the cabinet, or wherever the prize bin is located. When there, the Z-axis motor lowers the vacuum head a pre-determined TIME and the prize is delivered to the player by turning off the vacuum pump and hence releasing the prize. After a brief pause the vacuum head returns to the full UP position and the random motion of the carriage begins again.

If, after the initial descent to the playfield and subsequent rise to the full UP position, the vacuum switch indicates that no prize has been won, the random motion of the carriage commences again without traveling to the prize delivery area.

The RC (Random Chance) mode is the same, except that after the DOWN pushbutton is pressed, the carriage makes a small random movement before the vacuum head descends.

In the NRC (No Random Chance) mode, the game functions essentially like a conventional crane game, except that the traditional claw is replaced by the vacuum suction cup. The player is provided with a joystick, and rather than the random movements of the carriage as featured in the Random Chance modes, the movement of the carriage is controlled by the player using the joystick provided. When the DOWN pushbutton is activated by the player, the vacuum head descends and game play proceeds as described above.

We claim:

1. An amusement device comprising a housing, a playing area with targets arranged in a random manner within the playing area, a pick-up device for capturing the targets, and a drive system for moving the pick-up device in a random motion, the drive system comprising:

a first motor for driving the pick up device back and forth in a first direction;

a second motor for driving the pick up device back and forth in a second direction;

means for reversing said first and said second motor when the pick up device reaches a boundary area; and a controller for receiving signals from the means for reversing said first and second motors and for communicating with the motors to change direction.

2. The amusement device of claim 1 wherein the means for reversing said first and second motor comprises a plurality of sensors that sense contact between a carrier of the pick up device and a boundary.

3. The amusement device of claim 2 wherein the carrier randomly moves in a horizontal direction along two axes without interaction by a player.

4. The amusement device of claim 3 wherein the carrier carries a vacuum pick-up device.

5. The amusement device of claim 3 wherein the carrier carries a claw-type pick-up device.

6. The amusement device of claim 3 further comprising player actuation means for ceasing the random motion of the carrier and initiating the controller to lower the pick-up device.

7. The amusement device of claim 3 wherein the controller determines when the random motion of the carrier ceases and lowers the pick-up device without interaction from a player.

8. The amusement device of claim 3 wherein the carrier is rectangular and has sensors positioned on each of four sides.

9. The amusement device of claim 8 wherein the sensors determine a proximity of the carrier to a boundary by contact with a surface of the boundary.

* * * * *